US005143226A

United States Patent [19]

Walton

[11] Patent Number: 5,143,226

[45] Date of Patent: Sep. 1, 1992

[54] APPARATUS FOR SORTING ARTICLES ACCORDING TO SIZE

[76] Inventor: John I. Walton, 15 Edward Street, Laidley, Queensland, 4341, Australia

[21] Appl. No.: 646,604

[22] PCT Filed: Aug. 11, 1989

[86] PCT No.: PCT/AU89/00342

§ 371 Date: Jan. 31, 1991

§ 102(e) Date: Jan. 31, 1991

[87] PCT Pub. No.: WO90/01378

PCT Pub. Date: Feb. 22, 1990

[51] Int. Cl.[5] ..... B07C 5/06

[52] U.S. Cl. ..... 209/624; 209/622; 209/665

[58] Field of Search ..... 209/621, 622, 623, 624, 209/665

[56] References Cited

U.S. PATENT DOCUMENTS

| | | | |
|---|---|---|---|
| 1,337,257 | 4/1920 | O'Quinn | 209/622 |
| 1,385,218 | 7/1921 | McIntyre | 209/622 |
| 1,448,689 | 3/1923 | Hatch | 209/622 |
| 2,645,342 | 7/1953 | Roberts | 209/622 |
| 3,038,605 | 6/1962 | Durand | 209/622 |
| 3,561,597 | 2/1971 | Youngblood | 209/622 |

FOREIGN PATENT DOCUMENTS

| | | |
|---|---|---|
| 1144996 | 10/1957 | France . |
| 1498675 | 10/1967 | France . |
| 8500092 | 8/1986 | Netherlands . |
| 177872 | 9/1935 | Switzerland . |

*Primary Examiner*—Donald T. Hajec
*Assistant Examiner*—Joseph A. Kaufman
*Attorney, Agent, or Firm*—Renner, Otto, Boisselle & Sklar

[57] ABSTRACT

Apparatus for sorting articles according to size comprising an endless conveyor (13) including a plurality of elongate conveyor members (16) pivotally linked to a pair of continuous chains (22) by rigid rods (24) located at each end of members (16). Chains (22) are driven by sprocket (21) in a circuitous path defined by rigid tracks (60) and (63), idler sprocket (23) and catenary (76). Conveyor members (16) move in a substantially oval path (15) having a flattened upper portion (17) defining an article support surface (18), and a flattened lower portion (67). Members (16) within support surface (18) are spaced from one another by variable amounts by virtue of the circuitous path followed by chains (22), and the spacings permit selected size articles to pass therethrough and be sorted from articles of different sizes.

13 Claims, 4 Drawing Sheets

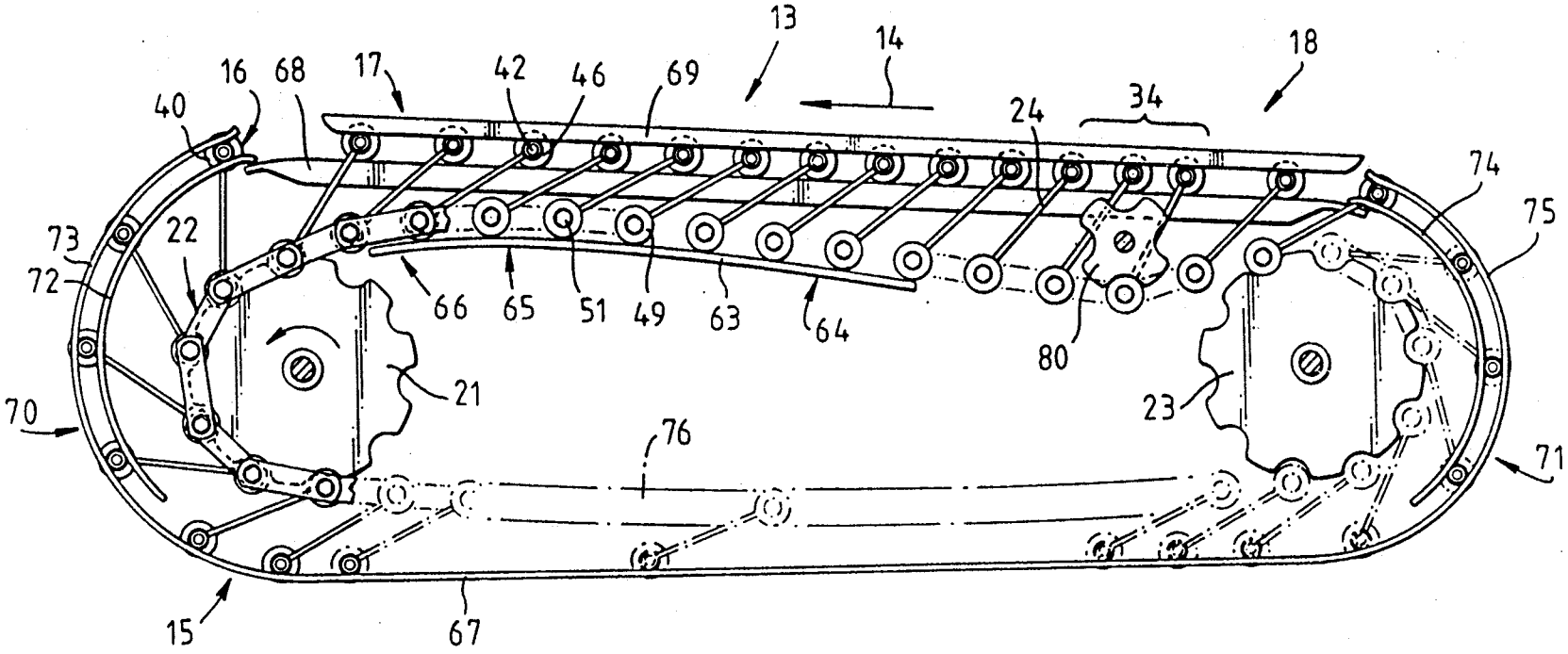
75
74
71
18
34
23
80
24
14
64
13
63
69
49
76
46
51
42
65
66
21
67
17
68
16
40
22
15
73
72
70

APPARATUS FOR SORTING ARTICLES ACCORDING TO SIZE

TECHNICAL FIELD OF THE INVENTION

This invention relates to an apparatus for sorting or grading bulk material, or loose articles fit to be handled like bulk material, according to size. The apparatus includes an endless conveyor having a plurality of parallel sorting elements, the spacing of which varies as the conveyor moves across a sorting area.

BACKGROUND ART

One known sorting machine includes a conveyor having a plurality of parallel sorting elements, the spacing of which increases across a sorting area. Individual elements are pivotally connected at each end to an endless roller chain by connecting links, with all of the connecting links being the same length. The elements also have a spigot projecting from each end. The machine further includes a pair of spaced worm gears of opposing helical pitch which run the length of the sorting area, with each worm gear having an increasing helical pitch from one end of the sorting area to the other. The spacing of the worm gears is such that the spigots of the sorting elements engage respective worm gears in the sorting area.

This machine has a complex conveyor drive system, wherein each roller chain is driven by a sprocket coupled to a gearbox and motor, and each gearbox also drives one of the worm gears. As the worm gears rotate in opposite directions to each other, they advance the sorting elements along the length of the sorting area. The spacing between adjacent sorting elements increases proportionally with the increase in helical pitch of the worm gears.

The main problem with this machine is the fact that the worm gears require careful and precise installation to ensure that the sorting elements remain parallel to each other along the length of the sorting area. This requires that each worm gear rotate at the same speed, and that corresponding loci on each opposed helix are directly opposite each other. These requirements are difficult, if not impossible, to achieve after the gearboxes and worm gears wear due to continued usage.

Another problem with this machine is that the worm gears generate forces in the sorting elements in directions both parallel to and normal to the line of travel of the elements. The normal forces increase friction and hence wear on the spigots of each of the sorting elements, and also the worm gears. If the spigots and worm gears are made from wear resistant materials, then the frictional forces increase, and there is an increased chance of the machine jamming. If the spigots and/or worm gears are made from low friction materials such as NYLON or TEFLON (both Trade Marks), then the amount of wear increases and sorting efficiency decreases due to the sorting elements moving from their parallel orientation to each other.

A yet further problem with this machine is the cost of manufacturing the opposed worm gears so that corresponding loci on each helix are directly opposite each other. The major component of this cost is due to the fact that the pitch of each helix increases from one end of the worm to the other, and this requires complicated and expensive machinery to produce.

Another sorting machine is described in British patent application no. 25399/75. In this machine, the sorting area is formed from an array of parallel grading rollers in the form of an endless driven loop. The rollers are mounted on T-shaped links within two parallel chains so that the spacing of the rollers depends on the path of the linking chains. Taking a straight path as the norm, pushing the chains into a convex path increases the roller spacing. Conversely, pushing the chains into a concave path reduces the roller spacing.

The path of the linking chains across the sorting area is determined by running each chain over a leaf spring, the curvature of which is adjusted to produce a suitable roller spacing.

The main disadvantage of this machine is that the spacing between the roller is substantially constant across the sorting area. Hence this machine will only separate out articles up to a particular size dependent on the roller spacing. If articles of several different sizes are required to be sorted from a quantity of bulk material, it is necessary to arrange a series of these machines with each successive machine having an increased roller spacing from the previous machine. Alternatively, if only one machine is used, the bulk material must be passed across the machine several times, with the roller spacing being increased for successive passes. Hence, while this machine is of comparatively simple construction, it has operational limitations when articles of several different sizes are required to be sorted from a quantity of bulk material.

OUTLINE OF THE INVENTION

The present invention aims to overcome or alleviate at least some of the abovementioned disadvantages by providing in a first aspect an apparatus for sorting articles according to size which results in a saving in time and cost both in the manufacture of the apparatus and in the sorting of the articles. The present invention also aims to provide an apparatus for sorting articles according to size which results in a saving in time and cost in the maintenance of the apparatus. Other objects and advantages of the invention will become apparent hereunder.

With the above and other objects in view, the present invention resides broadly in an apparatus for sorting articles according to size comprising a plurality of elongate conveyor members each being pivotally linked by a rigid rod at one end to a first continuous chain and at the other end to a second continuous chain; at least one of said first and second continuous chains being driven by a drive mechanism to move said conveyor members in a continuous looped path; said path including a section which acts as an article support surface; wherein the conveyor members which constitute the support surface are spaced from one another by variable amounts by virtue of a circuitous path which associated linked sections of the first and second continuous chains take, said variable spacings being such as to permit selected size articles to pass therethrough and to thereby be sorted from articles of different sizes.

Suitably the circuitous path is formed by rigid tracks over which the first and second continuous chains pass. Preferably each rigid track is formed by two metal plates, one of which is arranged to extend the distance between the continuous chains and the support surface, and the other of which is arranged to decrease the distance between the continuous chains and the support surface. Alternatively, one rigid track is formed by a pair of sprocketed wheels which are adapted to engage each chain and to extend the distance between the continuous chains and the support surface, and the remaining rigid tracks are formed by two metal plates which are arranged to decrease the distance between the continuous chains and the support surface.

Advantageously, the continuous looped path in which the elongate conveyor members move is defined by a vertical rail adjacent the respective ends of each conveyor member, with each said rail having a substantially oval configuration with flattened upper and lower sections; wherein said flattened upper section constitutes the article support surface.

Preferably, the drive mechanism to move said conveyor members in said continuous looped path includes two pairs of sprocketed wheels located at a maximum spaced location within the continuous looped path, with said first and second continuous chains passing around one sprocketed wheel of each pair of sprocketed wheels; wherein one pair of sprocketed wheels is driven by a suitable driving mechanism connected to a motor, and the other pair of sprocketed wheels is free to idle or rotate.

Suitably the article support surface forms an inclined plane, with the angle of inclination being in the direction of movement of the elongate conveyor members.

Advantageously the spacings between adjacent elongate conveyor members which form the article support surface increase in the direction of movement of the conveyor members.

Preferably the apparatus for sorting articles according to size further comprises a movable surface positioned directly beneath the article support surface for removing sorted articles which fall through the spacings between adjacent conveyor members. Desirably, there is further included dividing walls located above said movable surface to permit articles sorted according to size to pass in individual streams to individual collection points.

It is further preferred that the apparatus of the invention is portable.

Advantageously, the apparatus of the invention is adapted to sort fruit and/or vegetables according to size.

BRIEF DESCRIPTION OF DRAWINGS

In order that the invention may be more readily understood and put into practical effect, reference will now be made to the accompanying drawings wherein:

FIG. 5 is a schematic side elevation similar to FIG. 4 depicting an alternative method forming the circuitous path.

BEST MODE FOR CARRYING OUT THE INVENTION

Figure 1:
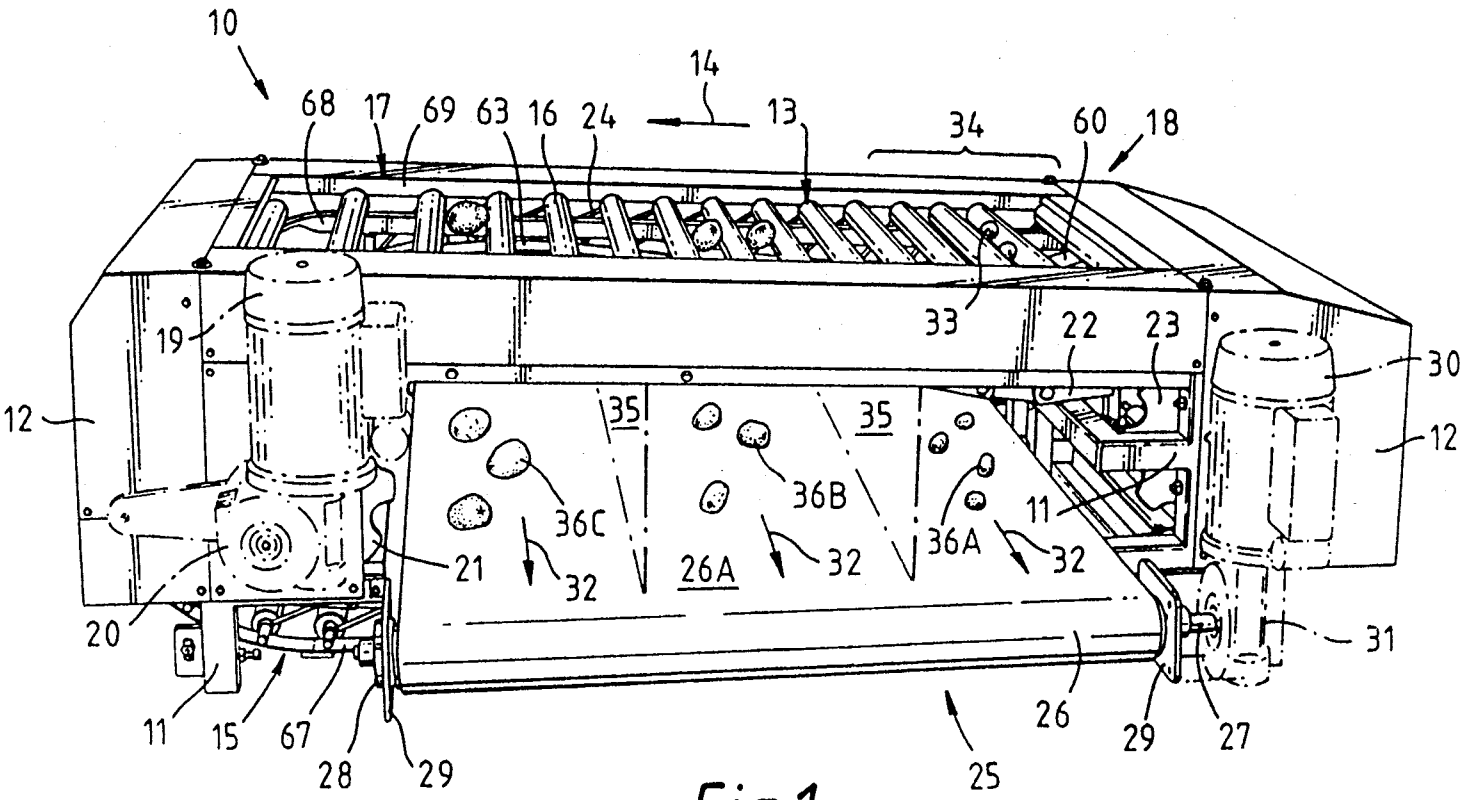
FIG. 1 is a perspective view of one embodiment of the sorting apparatus provided by the present invention.

Referring to FIG. 1, there is shown sorting apparatus 10 which comprises a suitable machine frame enclosed by a series of removable covers 12. Covers 12 are provided to prevent clothing, limbs and appendages of the people operating the apparatus from becoming entangled in the moving components.

Frame 11 supports an endless moving conveyor 13 which moves in the direction of arrow 14, and which is supported on each side by a pair of vertical rails 15. Rails 15 guide a plurality of elongate conveyor members 16 to form a continuous looped path having a flattened upper section 17 defining an article support surface 18. This path will be described in more detail with reference to FIG. 4.

Moving conveyor 13 is driven by a suitable electric motor 19 which is coupled to a pair of sprocketed wheels 21 through gearbox 20 secured to frame 11. Each sprocketed wheel 21 engages a continuous chain 22 which moves about another pair of sprocketed wheels or idlers 23 in a circuitous path (not shown for clarity). Every conveyor member 16 is pivotally linked to a chain 22 at each end by rigid rod 24.

Movable surface or conveyor 25 is located directly below article support surface 18 and includes a suitable endless belt 26 driven by drive roller 27 at its outboard end, and supported at its inboard end by an idler roller (not shown for clarity). Each roller is mounted by suitable bearings 28 attached to brackets 29 which are in turn secured to frame 11. Drive roller 27 is driven by a suitable electric motor 30 through gearbox 31 so that the top surface 26A of belt 26 coves outwards in the direction of arrows 32.

As can be seen from FIG. 1, the spacing between adjacent conveyor members 16 increases as the conveyor 13 moves in the direction of arrow 14. Hence, if a quantity of dry bulk material 33 is placed on article support surface 18 in the area indicated 34, then it will be sorted according to size as conveyor 13 moves across support surface 18. Dividing walls 35 can be provided located above conveyor 25 to divide the sorted material into several individual streams 36A, B, C.

Preferably dry bulk material 33 comprises agricultural products such as fruits (e.g. apples, oranges, etc.) or vegetables (e.g. beets, carrots, potatoes, etc.). Alternatively, the dry bulk material could be construction material such as gravel, aggregate, rooks, etc., though any other dry solids can be separated or sorted according to size.

Figure 2:
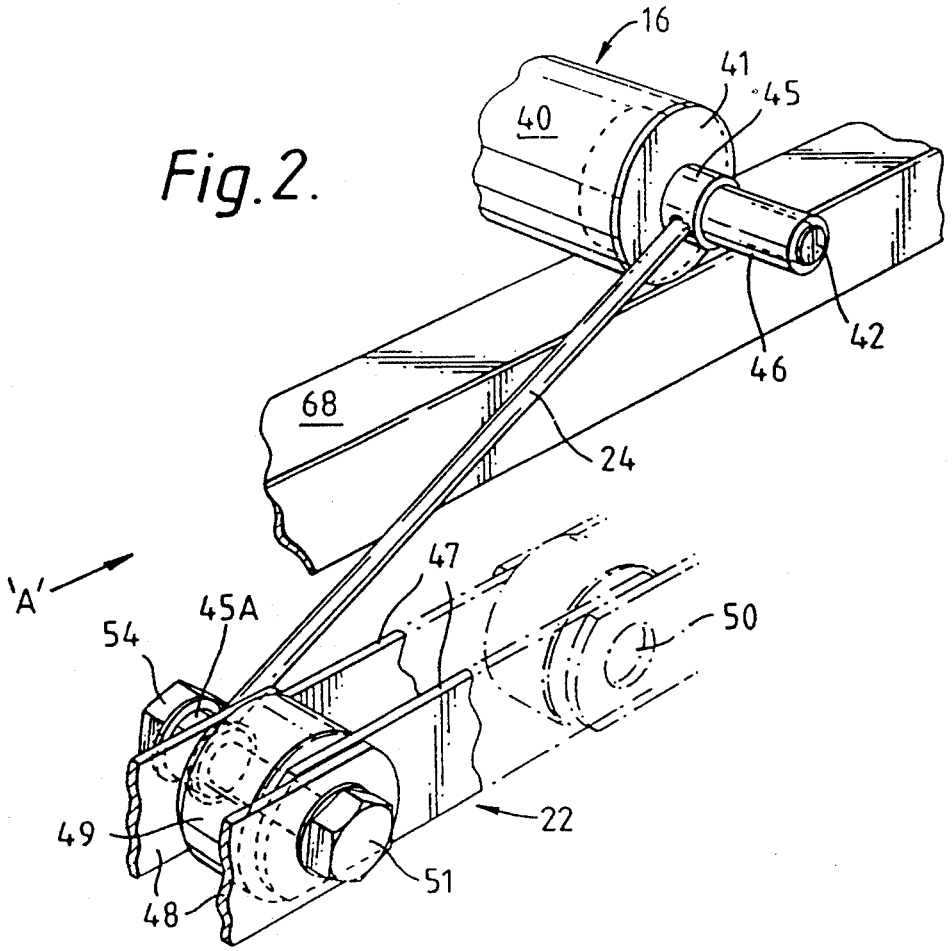
FIG. 2 is a perspective view of an enlarged detail depicting the method used to link the conveyor members to the continuous chains.
Figure 3:
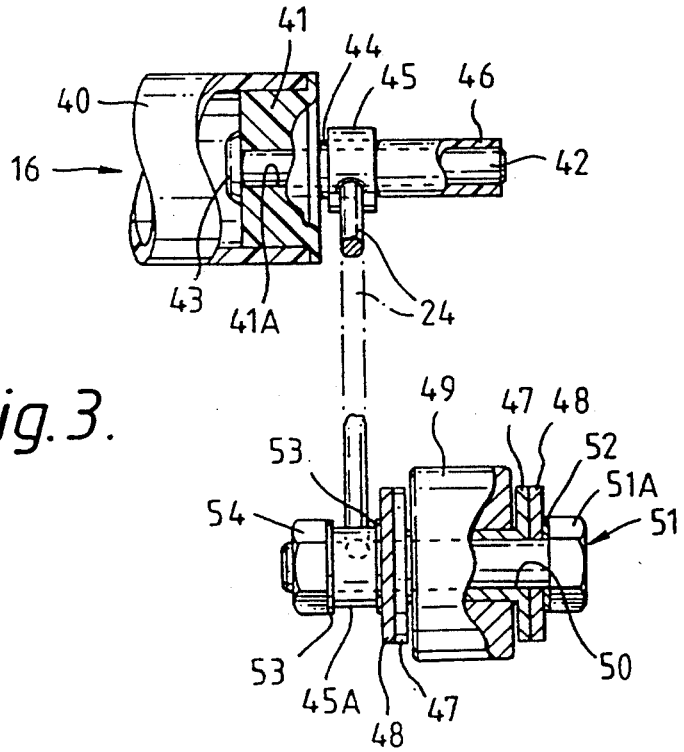
FIG. 3 is a fragmentary cross-sectional view of the detail of FIG. 2 when viewed in the direction of arrow "A"

Reference will now be made to FIGS. 2 and 3 which depict the method used to link elongate conveyor member 16 to each continuous chain 22.

Each elongate conveyor member 16 comprises a hollow tube 40 made from a piece of polyvinyl chloride piping, metal piping or similar material having an end plug 41 glued or pressed into each open end. Steel pin 42 is secured to plug 41 coaxially with the longitudinal axis of tube 40 such that head 43 of pin 42 is inside tube 40 and pin 42 projects outwards.

Rigid rod 24 is adapted at each end to provide bosses 45 and 45A. Boss 45 is adapted to rotatably mount on pin 42 adjacent plug 41 with spacer 44 interposed therebetween. Sleeve 46 is attached to pin 42 outboard of boss 45, and is made from a suitable low friction and wear resistant material such as heat-treated steel or a fluoroplastic material. Sleeve 46 cooperates with vertical rail 15 (not shown) to support end guide conveyor member 16 in its continuous looped path.

Each continuous chain 22 comprises a multiplicity of outer side plates 48, inner side plates 47, rollers 49 and through bores 50 coaxial with each roller 49. Associated with each bore 50 is bolt 51 which has a washer 52 interposed between its head 51A and side plate 48. Rod 24 is rotatably mounted on bolt 51 on the inboard side of chain 22 and is secured in position by suitable nut 54, with a pair of washers 53 inserted between nut 54 and boss 45A, and side plate 48 and boss 45A respectively. Hence, elongate conveyor member 16 is pivotally secured to continuous chain 22.

Figure 4:
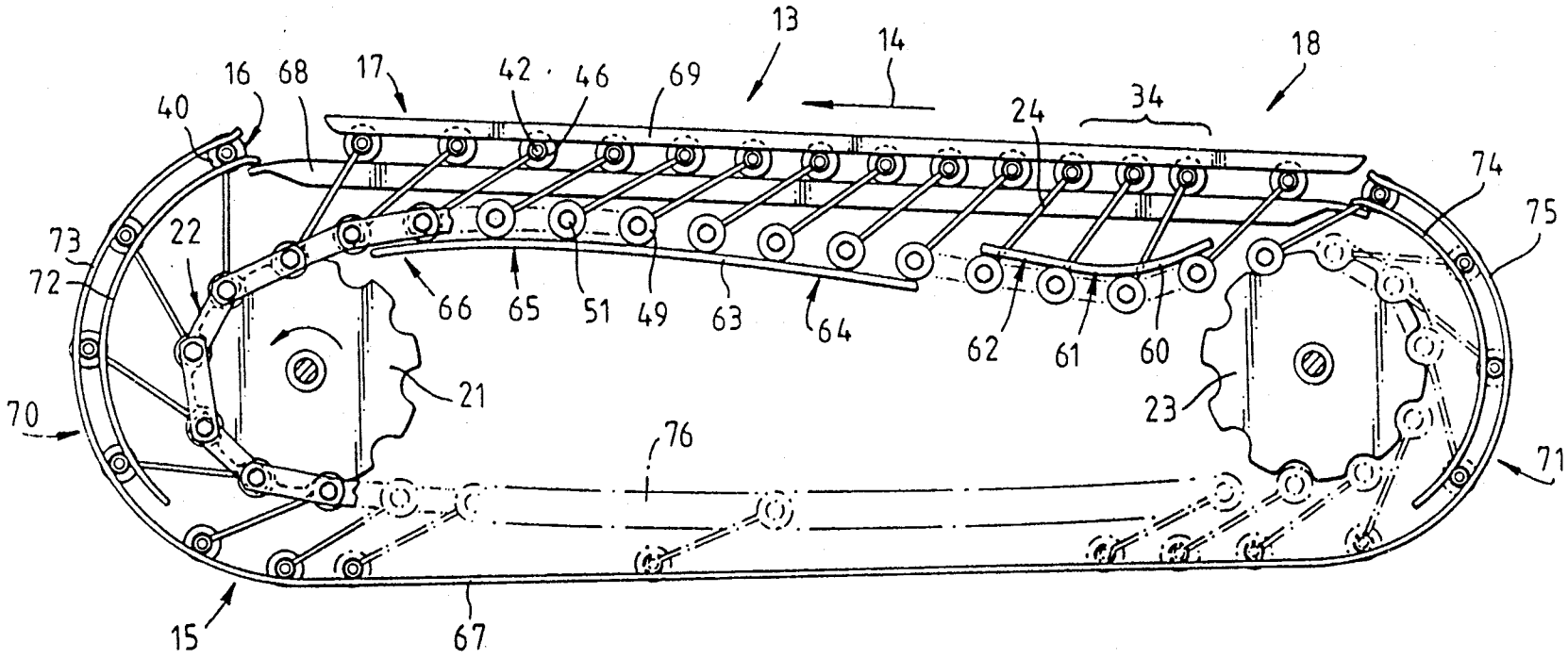
FIG. 4 is a schematic side elevation depicting the respective paths followed by the elongate conveyor members and associated continuous chains of the apparatus of FIG. 1.

Referring to FIG. 4, there is shown the circuitous path followed by chains 22 and the substantially oval path followed by conveyor members 16. In this figure, frame 11, covers 12, motor 19, gearbox 20, and conveyor 25 have been removed for clarity.

Each chain 22 is driven around the circuitous path by sprocketed wheels 21 (only one of which is depicted in the drawings) which engage with rollers 49. As chain 22 departs idler 23, rollers 49 engage with rigid track 60 which increases the distance between the continuous chains 22 and article support surface 18. As chain 22 is guided by track 60 towards its furthest distance from support surface 18 at 61, the effective forward speed of conveyor member 16 is reduced to a minimum and the spacing between adjacent elongate conveyor members 16 is reduced.

Once chain 22 passes point 61, it commences to follow an arcuately converging path with support surface 18 as guided by portion 62 of track 60, and portion 64 of track 63. During this arcuately converging path, the effective forward speed of conveyor members 16 gradually increases, as does the spacing between adjacent conveyor members 16. Effective forward speed of conveyor members 16 to chain 22 forward speed is achieved at point 65 on track 63 where the distance between tracks 63 and support surface is reduced to a minimum. The maximum effective forward speed of conveyor members 16 is achieved just prior to members 16 departing support surface 18, and chain 22 engaging sprocket 21. From point 65, chain 22 follows portion 66 of track 60 on a diverging path from support surface 18 until roller 49 engages with sprocket 21, and the spacing between adjacent conveyor members 16 continues to increase.

A region 34 of support surface 18, the changes to the effective forward speed of conveyor members 16 are caused by changes in direction of lower end of rod 24 negotiating diverging track section 69 (increasing speed and distance between conveyor members) then negotiating the converging section 61 to 62 thereby reducing conveyor member speed and distance between adjacent conveyor members.

These changes in speed are necessary to cause a slow conveyor member speed at start of region 34, so that a suitable continuous acceleration of conveyor members with relative increasing gaps between can be applied for full length of sorting area.

Elongate conveyor members 16 are supported and guided in their movement by vertical rails 15. As described previously, rails 15 have a substantially oval configuration with a flattened upper section 17 and a flattened lower section 67. Upper section 17 inclines upwards in the direction of travel 14 and comprises a pair of cooperating inner and outer guide rails 68 and 69 respectively. Lower section 67 and outer guide rail 69 cooperate with sleeve 46 of each elongate conveyor member 16, with section 67 guiding members 16 on the return side of conveyor 13, and guide rail 69 restraining members 16 from upwards movement while conveyor 13 moves across article support surface 18. Inner guide rail 68 cooperates with hollow tube 40 of each conveyor member 16 to support the mass of bulk material 33 (not shown in FIG. 4) while conveyor 13 transits the article support surface 18.

Vertical rail 15 also includes a pair of end guide rails 72 and 73 at the driven end 70 of conveyor 13, and a corresponding pair of end guide rails 74 and 75 at the idler end 71 of conveyor 13. Rails 72 and 73 are of a larger radius than rails 74 and 75 since, as described above, the article support surface 18 is inclined upwards in the direction of travel 14 of conveyor 13. End guide rails 72, 73 and 74, 75 are spaced such that they guide sleeve 46 of each conveyor member 16 between the article support surface 18 and flattened lower section 67.

All of guide rails 67, 68, 69, 71, 72, 73 and 74 are made from suitable steel barstock, and all are attached to machine frame 11 of sorting apparatus 10. Similarly, rigid tracks 60 and 63 are also made from steel and secured to frame 11.

To reduce the effects of backlash and wear within conveyor 13, it is advantageous to operate conveyor 13 with the article support surface 18 inclined as previously described. This inclination produces two advantages; firstly, chains 22 are being "dragged" uphill, which extends chain 22 and removes any looseness due to wear, etc.; and secondly, the mass of each conveyor member 16 combines with the friction forces created by guiding conveyor 13 through upper section 17 to remove any backlash and wear within the connection of rigid rod 24 to chain 22 and conveyor member 16. Hence, conveyor members 16 remain substantially parallel through article support surface 18.

Also, it is advantageous to drive chain 22 with sprocketed wheel 21 since this manner of operation pulls chain 22 over rigid tracks 60 and 63, and also tends to extend chain 22 to remove any backlash etc., and maintain conveyor members 16 substantially parallel to each other. If sprocketed wheel 23 is used to drive chain 22, it has to push chain 22 over rigid tracks 60, 63 and this action could cause chain 22 to "kink", and hence affect the spacing between adjacent conveyor members 16.

Further backlash etc. is removed by allowing chain 22 to hang "free" in the shape of a catenary as shown at 76 in FIG. 4, as this ensures that chain 22 properly engages idler 23 when sprocketed wheel 21 is the drive sprocket.

Referring to FIG. 5, there is shown a schematic side elevation similar to FIG. 4, except that each rigid track 60 has been replaced with a pair of sprocketed wheels 80. Sprocketed wheels 80 are idler sprockets rotatably mounted on frame 11 (not shown), and are free to rotate at a rate dependent upon the speed of conveyor 13. The operation of conveyor 13 in FIG. 5 is similar to that described previously for FIG. 4 with similar parts retaining the same reference numbers.

The foregoing description has illustrated just two embodiments of a sorting apparatus according to the present invention. A person skilled in the art may make other modifications or changes to the sorting apparatus without departing from the scope of the invention. For example, a sorting apparatus may be provided which has two or more article support surfaces with only a single endless conveyor, so that the conveyor follows a sinuous path on its upper surface.

A further modification may comprise altering the arcuate profile of tracks 60 and 63. This will result in a change to the spacing between adjacent conveyor members 16. Hence several different profiles may be available, with each profile capable of grading articles between differing size limits.

I claim:

1. Apparatus for sorting articles according to size comprising a plurality of elongate conveyor members, first and second continuous chains, a plurality of rigid rods pivotally linking said conveyor members to said first and second continuous chains, each said conveyor member being pivotally connected at opposite ends thereof to respective said rigid rods that extend perpendicular to the axis of said conveyor member and are pivotally connected respectively to said first and second continuous chains, a drive mechanism for driving at least one of said first and second chains in a circuitous path to move said conveyor members in a continuous looped path, a conveyor support for supporting said conveyor members in a line along a section of said looped path which functions as an article support surface, and first and second rigid tracks over which each said continuous chain passes as the conveyor members pivotally linked thereto move along said section of said looped path, each rigid track being formed by two metal plates, one of which is arranged to increase the distance between the continuous chains and the support surface, and the other of which is arranged to decrease the distance between the continuous chains and the support surface, and wherein the line of conveyor members which constitute the support surface are spaced from one another by increasing spacings in the direction of movement of the conveyor, said increase in spacings being effected, at least in part, by virtue of the individual chain links to which the conveyor members are connected being drawn closer to said support surface by said rigid tracks, in the direction of movement of the conveyor members, said spacings being such as to permit selected size articles to pass therethrough and to thereby be sorted from articles of larger sizes.

2. Apparatus for sorting articles according to size as claimed in claim 1, wherein said continuous looped path in which the elongate conveyor members move is defined by a vertical rail adjacent the respective ends of each conveyor member, with each said rail having a substantially oval configuration with flattened upper and lower sections; whereby said flattened upper section constitutes the article support surface.

3. Apparatus for sorting articles according to size as claimed in claim 1, whereby the drive mechanism to move said conveyor members in said continuous looped path includes a motor, and two paris of sprocketed wheels located at a maximum spaced location within the circuitous path, with said first and second continuous chains passing around one sprocketed wheel of each pair of sprocketed wheels; wherein one pair of sprocketed wheels is driven by said motor, and the other pair of sprocketed wheels is free to idle or rotate.

4. Apparatus for sorting articles according to size as claimed in claim 1, wherein the article support surface forms an inclined plane, with the angle of inclination being in the direction of movement of the elongate conveyor members.

5. Apparatus for sorting articles according to size as claimed in claim 4, wherein the spacings between adjacent elongate conveyor members which form the article support surface each progressively increase in the direction of movement of the conveyor members.

6. Apparatus for sorting articles according to size as claimed in claim 5 further including a movable surface positioned directly beneath the article support surface for removing sorted articles which fall through the spacings between adjacent conveyor members.

7. Apparatus for sorting articles according to size as claimed in claim 6 further including dividing walls located above said movable surface to permit articles sorted according to size to pass in individual streams to individual collection points.

8. Apparatus for sorting articles according to size as claimed in claim 1, wherein the spacings between adjacent elongate conveyor members which form the article support surface each progressively increase in the direction of movement of the conveyor members.

9. Apparatus for sorting articles according to size comprising a plurality of elongate conveyor members, first and second continuous chains, a plurality of rigid rods pivotally linking said conveyor members to said first and second continuous chains, each said conveyor member being pivotally connected at opposite ends thereof to respective said rigid rods that extend perpendicular to the axis of said conveyor member and are pivotally connected respective to said first and second continuous chains, a drive mechanism for driving at least one of said first and second chains in a circuitous path to move said conveyor members in a continuous looped path, a conveyor support for supporting said conveyor members in a line along a section of said looped path which functions as an article support surface, and first and second rigid tracks over which each said continuous chain passes as the conveyor members pivotally linked thereto move along said section of said looped path, said rigid tracks being formed by a pair of sprocketed wheels and by two metal plates, the sprocketed wheels being adapted to engage each said chain and to increase the distance between the continuous chains and the support surface, and the two metal plates being arranged to decrease the distance between the continuous chains and the support surface, and wherein the line of conveyor members which constitute the support surface are spaced from one another by increasing spacings in the direction of movement of the conveyor, said increase in spacings being effected, at least in part, by virtue of the individual chain links to which the conveyor members are connected being drawn closer to said support surface by said rigid tracks, in the direction of movement of the conveyor members, said spacings being such as to permit selected size articles to pass therethrough and to thereby be sorted from articles of larger sizes.

10. Apparatus for sorting articles according to size as claimed in claim 9, wherein said continuous looped path in which the elongate conveyor members move is defined by a vertical rail adjacent the respective ends of each conveyor member, with each said rail having a substantially oval configuration with flattened upper and lower sections; whereby said flattened upper section constitutes the article support surface.

11. Apparatus for sorting articles according to size as claimed in 9, wherein the article support surface forms an incline plane, with the angle of inclination being in the direction of movement of the elongate conveyor members.

12. Apparatus for sorting articles according to size as claimed in claim 11, wherein the spacings between adjacent elongate conveyor members which form the article support surface each progressively increase in the direction of movement of the conveyor members.

13. Apparatus for sorting articles according to size as claimed in claim 9, wherein the spacings between adjacent elongate conveyor members which form the article support surface each progressively increase in the direction of movement of the conveyor members.

* * * * *